US006083091A

United States Patent [19]

Anderson

[11] Patent Number: 6,083,091

[45] Date of Patent: Jul. 4, 2000

[54] MACHINE FOR CONTINUOUSLY ADVANCING SANDPAPER ON A PALM SANDER

[75] Inventor: Jack W. Anderson, 291-46 Flynn Rd., Silver Creek, Wash. 98585

[73] Assignee: Jack W. Anderson, Silver Creek, Wash.

[21] Appl. No.: 09/174,735

[22] Filed: Oct. 19, 1998

[51] Int. Cl.[7] ..... B24B 23/06

[52] U.S. Cl. ..... 451/355; 451/356; 451/491; 451/492; 451/493

[58] Field of Search ..... 451/491, 492, 451/493, 356, 355, 357

[56] References Cited

U.S. PATENT DOCUMENTS

| | | | |
|---|---|---|---|
| 2,995,877 | 8/1961 | Richmond | 51/187 |
| 3,727,351 | 4/1973 | Hughes | 51/361 |
| 3,843,034 | 10/1974 | Lewandowsky | 225/43 |
| 4,478,011 | 10/1984 | Russell | 51/360 |
| 4,826,063 | 5/1989 | Ban | 225/52 |

*Primary Examiner*—Joseph J. Hail, III
*Assistant Examiner*—William Hung
*Attorney, Agent, or Firm*—Patentpro

[57] ABSTRACT

A machine for continuously advancing sandpaper on a palm sander has a rear clamp bracket for holding a roll of sandpaper substantially longer than the sanding surface of the palm sander and stabilizing one end of a section of the sandpaper and a front clamp bracket for securing the opposite end of a section of the sandpaper. The machine also has a means for attaching the front and rear clamp brackets to an existing palm sander. The front clamp bracket also comprises a cut-off bracket to separate used sandpaper.

3 Claims, 2 Drawing Sheets

MACHINE FOR CONTINUOUSLY ADVANCING SANDPAPER ON A PALM SANDER

BACKGROUND OF THE INVENTION

This invention relates generally to the field of electric palm sanders, and more particularly to a machine for continuously advancing sandpaper on a palm sander. The finishing of wood products is often accomplished by sanding using various grits of papers attached to an electric palm sander that oscillates or vibrates the paper. Of course, the sandpaper may be used without being attached to anything. In the case of the block or palm sander, paper, attached one sheet at a time, must be changed when the grit becomes too worn to remove more product from the sanded object. Making this change is time consuming and often awkward and translates to much down time. Moreover, a section of the paper used for attaching is often wasted and unusable.

SUMMARY OF THE INVENTION

A principal object of the present invention is to provide a continuous sanding surface that may be advanced from stored, unused sandpaper to a surface for use to a used, discarded position.

Another object of the invention is to provide a means of reducing set up time in placing new sandpaper for sanding.

Another object of the invention is to shorten total time expended in sanding a given surface.

A further object of the invention is to provide a means of reducing wasted sandpaper.

Yet another object of the invention is to reduce overall surface preparation time.

Still yet another object of the invention is to provide a more simple means of loading sandpaper.

Another object of the invention is to provide a new sanding surface without stopping to replace worn paper.

Another object of the invention is to provide a durable sandpaper holding adapter that is shock resistant.

A further object of the invention is to provide new surface stock on the palm sander.

Yet another object of the invention is to provide for easy advancement of stored sandpaper.

Still yet another object of the invention is to provide a means of total cost reduction in the sanding process.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, a machine for continuously advancing sandpaper on a palm sander comprises:

- a rear clamp bracket for holding a roll of sandpaper substantially longer than a sanding surface of the palm sander and stabilizing one end of a section of the sandpaper; and
- a front clamp bracket for sewing the opposite end of a section of the sandpaper.

The drawings constitute a part of this specification and include exemplary embodiments to the invention, when may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
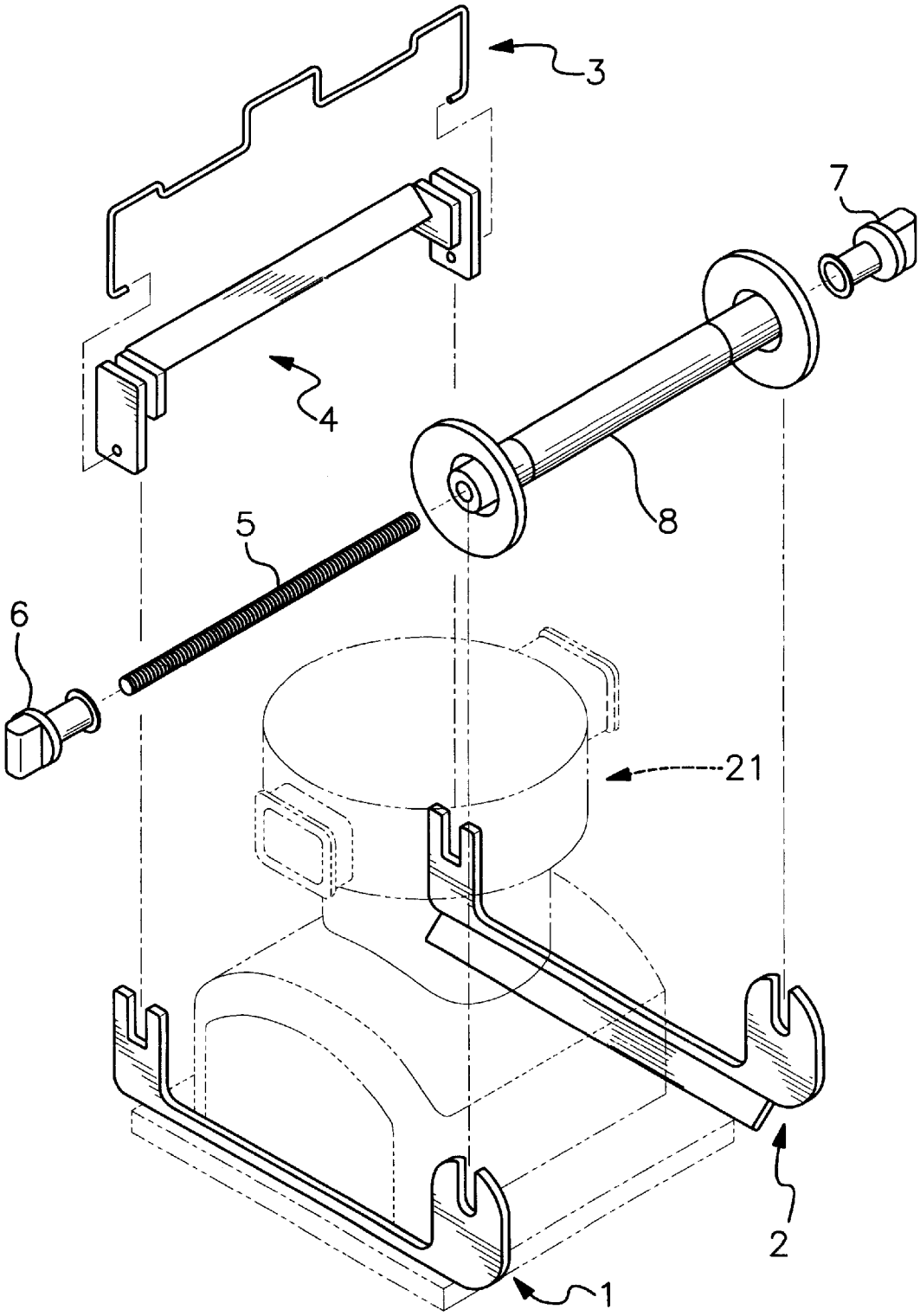
FIG. 1 is a perspective exploded view of an embodiment of the present invention showing attachment to a palm sander.

Turning first to FIG. 1, an exploded view, shows the machine and its components in relation to a typical palm sander 21. Threaded rod 15 is then positioned, onto which end cap 16 is threaded. Rod 15 and end cap 16 are then fed through roller assembly 18, which may be pre-loaded with a roll of sandpaper. End cap 17 is then threaded onto opposite end of threaded rod 15 and the assembly is installed in rear bracket 12 which may be attached to palm sander 21 under the wire clamping mechanism.

The sandpaper is then threaded from roller assembly 18 from rear bracket 12 to over palm sander 21 sanding surface and secured at front bracket 11. Front bracket 11 can hold wire clamp 13 that snaps into slotted ends of cut-off bracket 14. Front bracket 11 is attached to palm sander 21 in a similar position as rear bracket 11. Used sandpaper may then be advanced from sanding surface of palm sander 21 to front bracket 12 and cut off and discarded.

In the preferred embodiment, front clamp bracket 11, rear clamp bracket 12, cut-off bracket 14, end caps 16 and 17, and roller 18 are made of 13% glass-filled nylon, though any suitable material may be used. Wire clamp 13 is made of spring steel and threaded rod 15 is low carbon steel.

Figure 2:
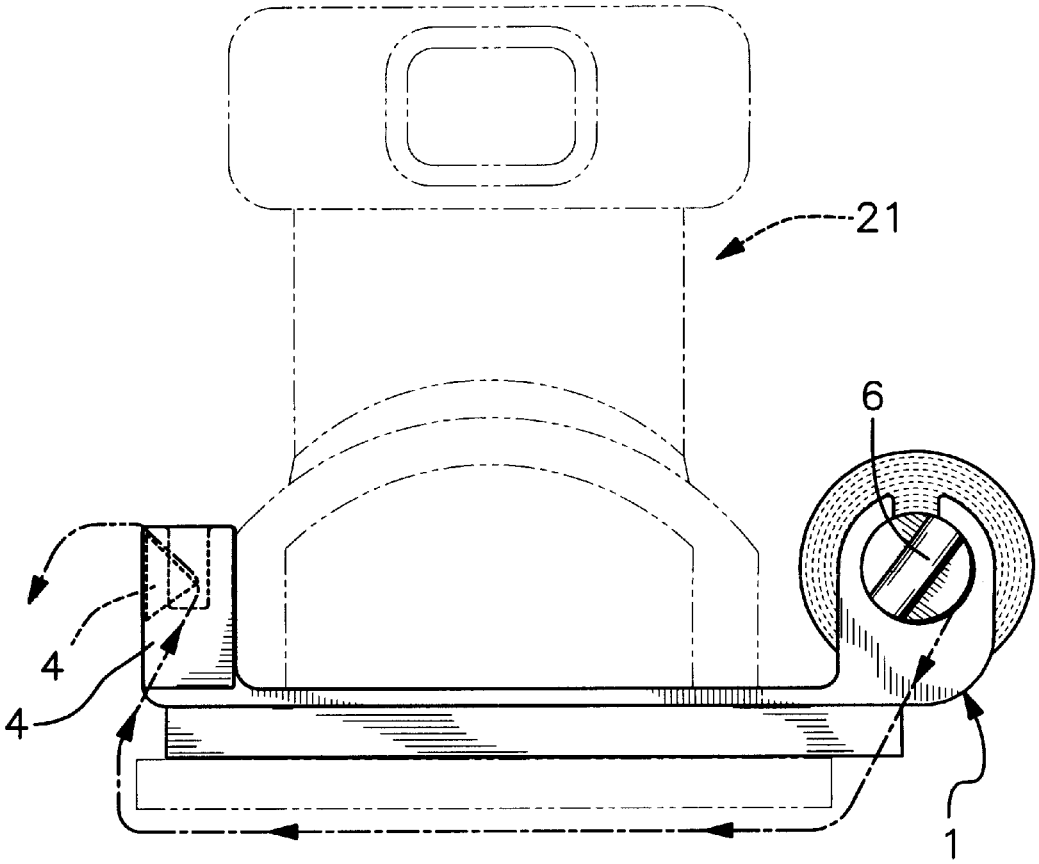
FIG. 2 is a perspective view of the invention illustrating the sandpaper interface with the palm sander.

To assemble, first attach clamp brackets 11 and 12 to the palm sander by releasing the spring hold down on the palm sander so that the clamp brackets slide under the hold downs. Align each bracket so that they line up each with the other so as not to obstruct function of the palm sander. Next assemble parts 13 and 14 followed by parts 15 and 16 into the assembly noted by part number 18 in FIG. 1. Slide assembled parts 13 and 14 down onto cutoff end of clamp brackets 11 and 12. Roller assembly 18 (consisting of parts 15, 16 and 17) into slots of parts 11 and 12 on the supply roll end of the sander. Advance the paper by pulling it along the path as shown in FIG. 2 between part number 13 (wire clamp) and part number 14 (cutoff bracket) tearing off excess and snap in place part number 13 (wire clamp).

Tear off excess paper; begin sanding. This and the end of the roll will be the last paper for which there is any waste at all; new paper will be advanced as required from the roller assembly 18 as required to finish surface.

Thus the device provides for continuously advancing unused paper across the pad surface of the electric palm sander in a time saving efficient manner resulting in cost savings for and refinishing project.

The machine continuously advances sandpaper on a palm sander with speed in advancing to unused grit. The sander need not be laid down on a bench to attach new sandpaper. No technology currently exists for replacing paper on an electric palm sander without attaching a single sheet. Per sheet of sandpaper cost is reduced and sanding time reduced by advancing the roll, up to 30 new sand grits per roll of paper on the adapter, production quantity improves because of time saved by not attaching single sheets, paper storage space is reduced, various grits may be set up on multiple sanders to save even more time, the adapter is universal to electric palm sanders.

The attachment is simplistic and positioned as not to impede the use of a vacuum unit or disrupt the functionality of the motor cool vents or make uncomfortable the operator's hand interface to the sander. The attachment design is such that it will not void the original manufacture's warranty on the palm sander.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An attachment for continuously advancing sandpaper for use with a palm sander comprising:

a detachable rear bracket attachable to the palm sander for holding a roll of sandpaper substantially longer than the sanding surface of the palm sander;

a detachable front bracket attachable to the palm sander for securing the opposite end of a section of the sandpaper; and a base member connecting the detachable front bracket and detachable rear bracket.

2. A machine as claimed in claim 1 wherein the front clamp bracket also comprises a cut-off bracket to separate used sandpaper.

3. A machine as claimed in claim 1 further comprising a means for attaching the front and rear clamp brackets to a palm sander.

* * * * *